United States Patent [19]

Liu

[11] Patent Number: 4,957,053

[45] Date of Patent: Sep. 18, 1990

[54] LINKING MECHANISM FOR SEWING MACHINE

[76] Inventor: Hsiao C. Liu, No. 21, Hwating Street, Taipei City, Taiwan

[21] Appl. No.: 231,273

[22] Filed: Aug. 12, 1988

[51] Int. Cl.[5] ..... D05B 29/02

[52] U.S. Cl. ..... 112/237; 112/239

[58] Field of Search ..... 112/237, 238, 239, 271, 112/277

[56] References Cited

U.S. PATENT DOCUMENTS

| | | | |
|---|---|---|---|
| 3,777,686 | 12/1973 | Hage | 112/237 |
| 4,658,742 | 4/1987 | Tanasescu et al. | 112/239 |
| 4,674,424 | 6/1987 | Shiomi et al. | 112/237 |
| 4,676,179 | 6/1987 | Nomura et al. | 112/239 |

FOREIGN PATENT DOCUMENTS

| | | | |
|---|---|---|---|
| 60-10754 | 3/1985 | Japan | 112/237 |
| 61-82788 | 4/1986 | Japan | 112/237 |
| 351826 | 3/1961 | Switzerland | 112/237 |

*Primary Examiner*—Leslie A. Braun
*Assistant Examiner*—Scott Anchell
*Attorney, Agent, or Firm*—Morton J. Rosenberg; David I. Klein

[57] ABSTRACT

A transmission mechanism used for sewing machines equipped with a carriage comprising a base plate having an opening, a fixing clamp for mounting the base plate to the carriage, and an apparatus for transmission which can be vertically attached to the base plate under the opening thereof. The transmission apparatus has a plunger passable through the opening to perform a reciprocating movement. The transmission apparatus has all its elements substantially disposed within a housing encased by an upper cover and a lower cover thereof to form an integral piece and to reduce the total length thereof.

2 Claims, 9 Drawing Sheets

LINKING MECHANISM FOR SEWING MACHINE

BACKGROUND OF THE INVENTION

The present invention relates to an improved transmission mechanism used to control the movement of a presser in sewing machines.

There are a variety of sewing machines on the market, which can be divided into two categories-hand-activated and electro-activated. The former is generally used in ordinary households while the latter is widely used in factories.

The need exists for a durable, inexpensive and easily constructed or repaired transmission mechanism in an electro-activated sewing machine. In the past, sewing machines have been constructed with the transmission mechanism positioned horizontally under the carriage of the sewing machine.

The traditional transmission mechanism for a sewing machine is very complicated, containing a large number of parts that are exposed to the environment and are thereby easily contaminated by dust, etc., which causes malfunctions to occur. Another disadvantage of the traditional transmission mechanism is that the presser moves vertically while the plunger of the transmission means moves horizontally. Therefore, extra parts are required by the transmission means to transform the horizontal movement of the plunger of the transmission means into the vertical movement of the presser. Consequently, the exposure of these members outside the transmission means makes the total length thereof relatively large, which in turn requires the horizontal orientation of the transmission mechanism resulting in an increase in the cost and the difficulty of repair.

The art has long sought a transmission mechanism which is durable, inexpensive and easily constructed or repaired. As shown below the transmission mechanism of the present invention meets this need.

SUMMARY OF THE INVENTION

The present invention, which includes the transmission means to be interconnected to the presser, overcomes the foregoing disadvantages to achieve the required functions. The present invention comprises a transmission means attached to a specially designed base plate, which may be readily and easily constructed, assembled underneath the carriage of the sewing machine.

This invention permits the transmission means to encompass all necessary parts inside its own casing. Furthermore, the transmission means is so constructed as to be placed vertically. Therefore, the plunger of the transmission means moves vertically and cooperates directly with a presser, known per se, disposed in the sewing machine.

It is an objective of the invention therefore to provide an improved transmission mechanism enclosing most of the parts inside the transmission means for protection against an environment full of dust and cloth fibers.

Another objective of the invention is to provide a vertically placed transmission mechanism, thereby reducing the number of connecting parts between the transmission mechanism and presser.

Further objectives and advantages of the present invention will become apparent as the following description proceeds, and the features of novelty which characterize the invention are pointed out with particularity in the claims annexed to and forming a part of this invention.

DETAILED DESCRIPTION OF THE PREFERRED EMBODIMENT

Figure 1:
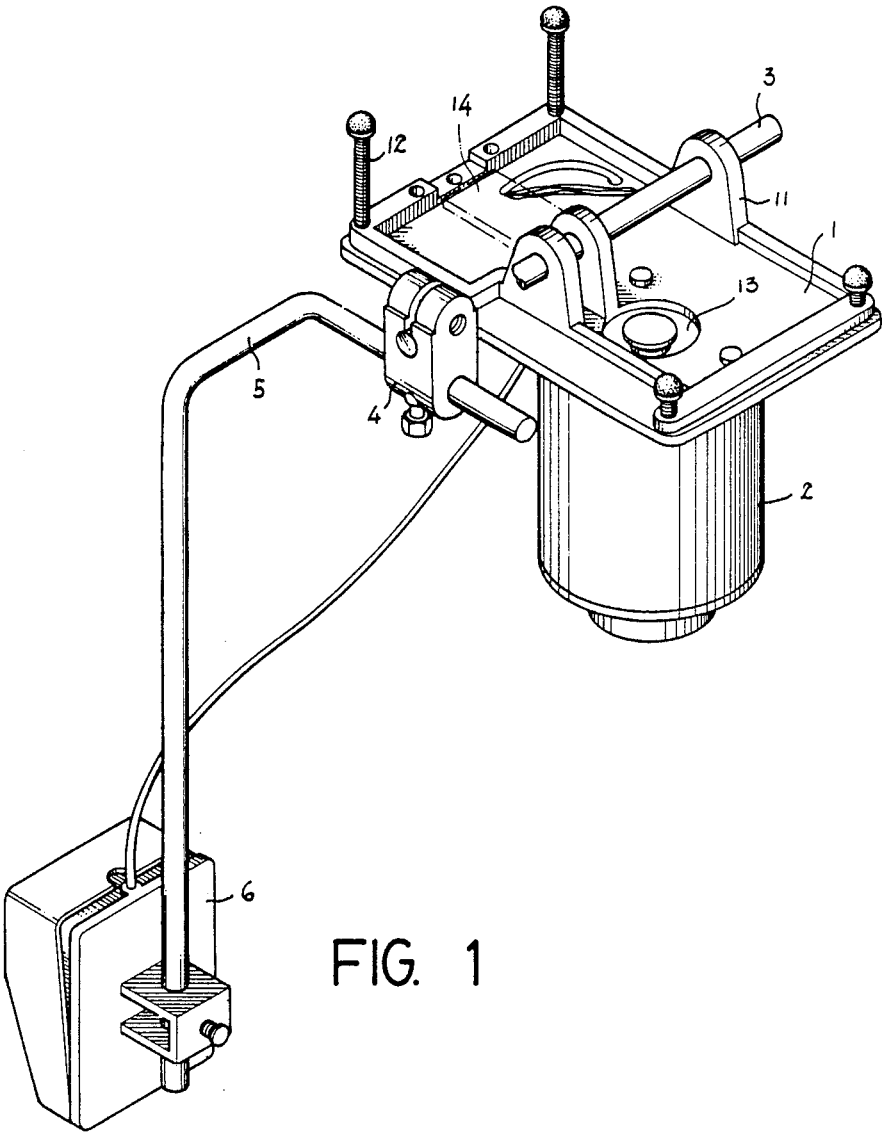
FIG. 1 is a perspective view of a transmission mechanism for a sewing machine in accordance with the present invention.
Figure 2:
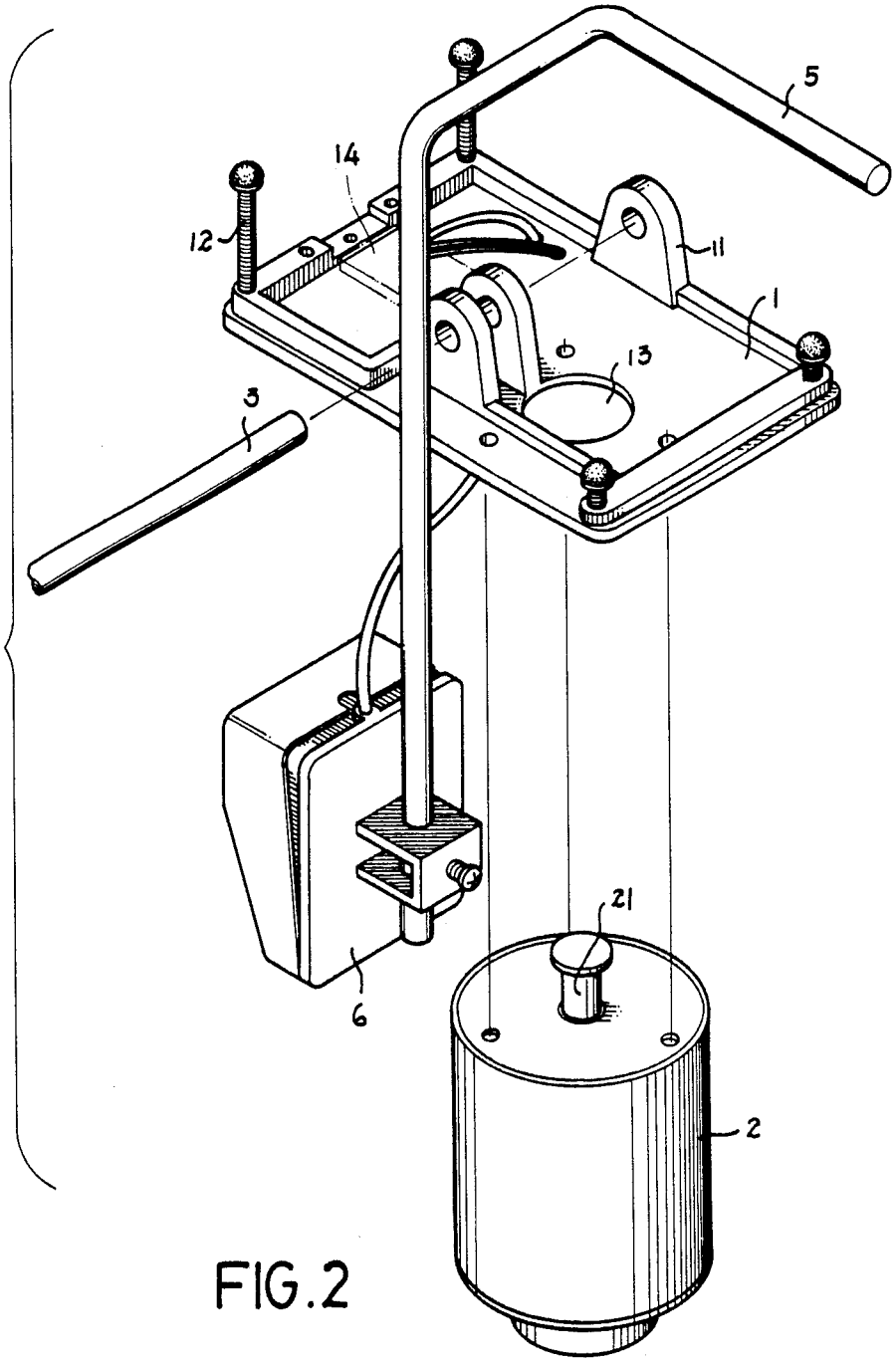
FIG. 2 is a partially exploded view of the transmission mechanism of FIG. 1 with the fixing clamp omitted for simplicity.
Figure 3:
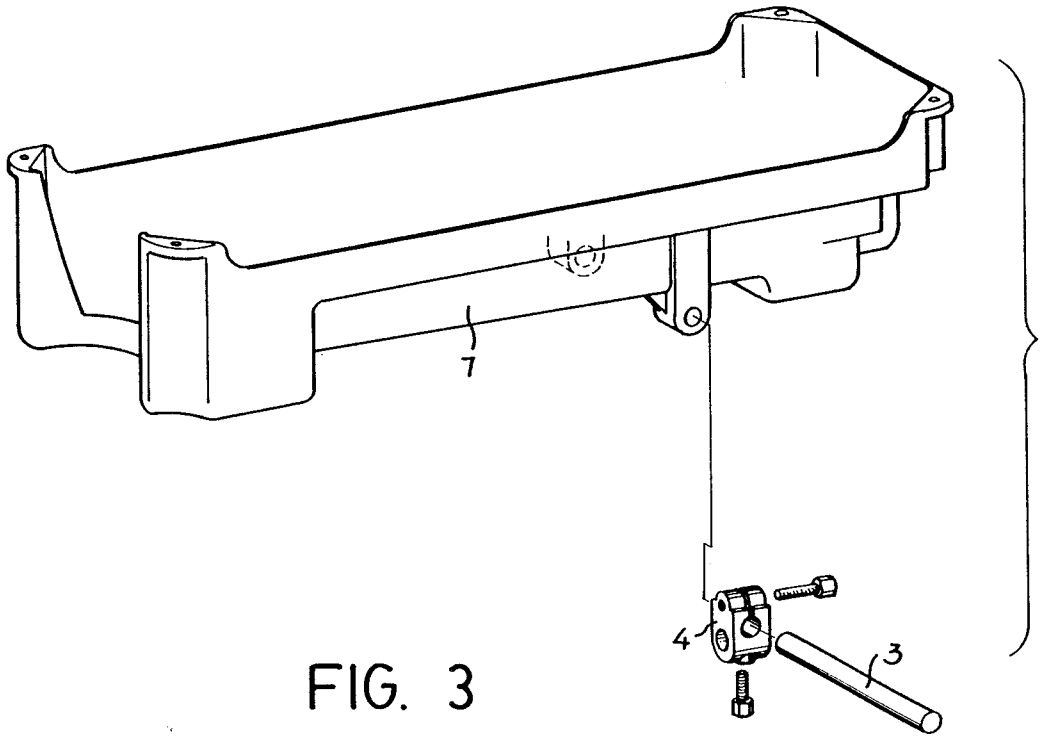
FIG. 3 shows the positioning of the bar and clamp of the present invention in a sewing machine.

Referring to FIGS. 1 and 2, there is illustrated a transmission mechanism of the present invention which comprises a specially designed base plate 1 to which a transmission means 2 is attached in a known manner. It can be seen that a bar 3 fits through three mounts 11 on the base plate 1 and also provides coupling to the carriage 7, as shown in FIG. 3. At an appropriate position an opening 13 is precisely disposed, allowing a plunger 21 of the transmission means 2 to move up and down through the opening 13 to operate the sewing machine.

There are provided four bolts 12 which are threadably disposed at each of the four corners of the base plate 1. Each of the four bolts 12 is provided with a plastic bolt head so that when the bottom of a carriage 7 (shown in FIG. 3) comes into contact with the base plate 1, the carriage 7 remains stable in a horizontal orientation thus allowing the sewing machine to operate smoothly. At an end of the base plate 1 is provided a circuit board 14 which is positioned between the base plate 1 and the carriage 7. Mounted at one end of the bar 3 is a fixing clamp 4 which in turn grips an end of a connecting rod 5. Another end of the connecting rod 5 is connected to a switch box 6. The switch box 6 is wired to the circuit board 14 for controlling actuation of the transmission means 2. Since the switch box 6 and the circuit board 14 are both constructed in a known manner and do not play a part of this invention, they will not be further described herein.

FIG. 3 particularly shows the orientation of the bar 3 and the fixing clamp 4 beneath the carriage 7 of the sewing machine.

Figure 4:
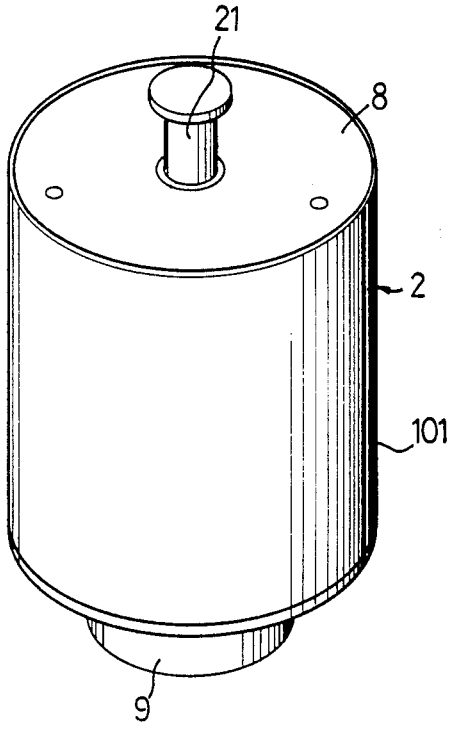
FIG. 4 is a perspective view of a transmission means in accordance with the present invention.

The preferred embodiment of the present invention employs the vertically positioned transmission means 2 to replace conventional transmission means which are horizontally oriented. With reference to FIG. 4, the transmission means 2 in accordance with the present invention can be seen, which comprises an upper cover 8, a lower cover 9, and the plunger 21 that protrudes from a middle portion of the upper cover of the transmission means 2.

Figure 5:
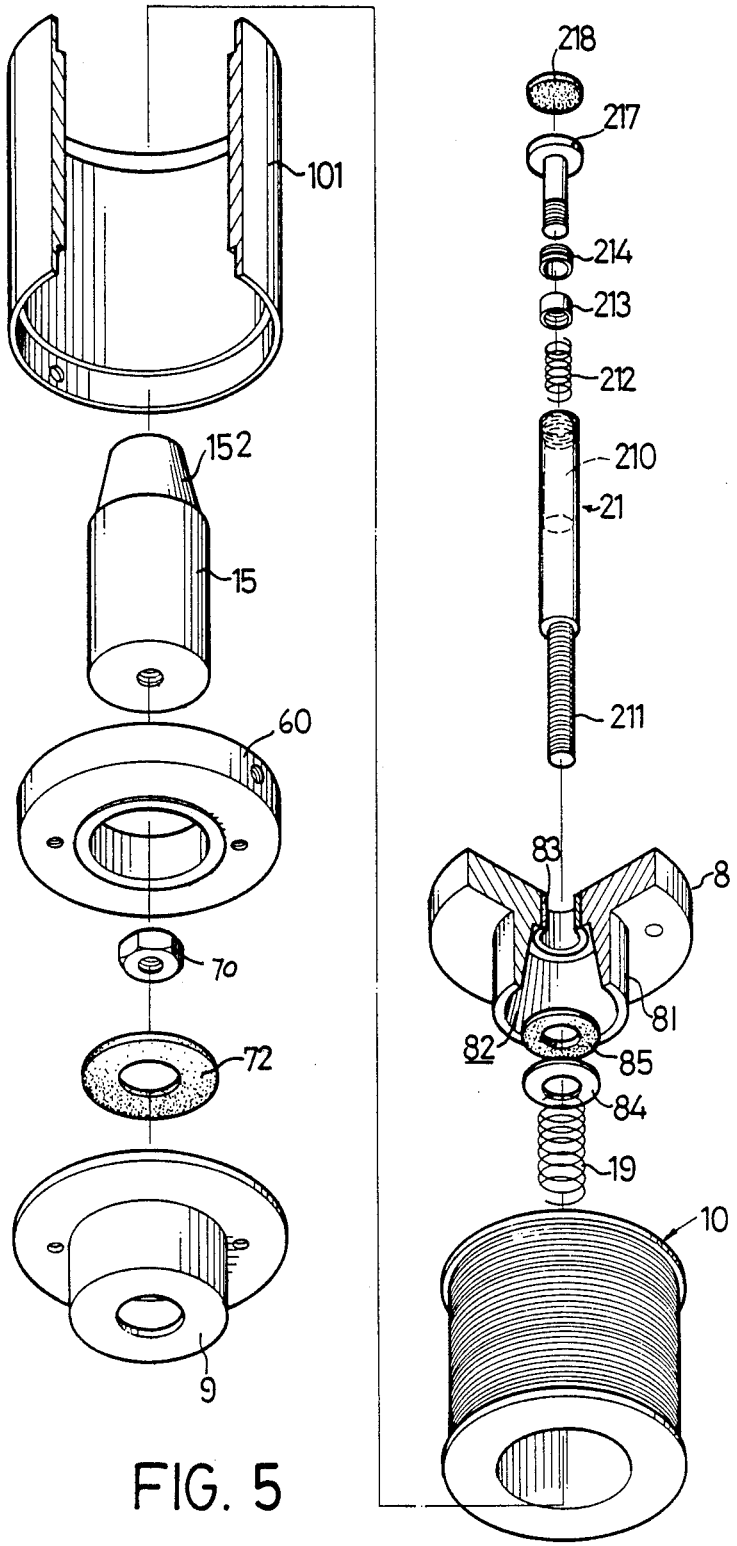
FIG. 5 is an exploded view of the transmission means of FIG. 4 in accordance with the present invention.

FIG. 5 shows the detailed structure of the transmission means 2. A solenoid 10 is mounted inside a housing 101. An iron core 15 is disposed within a center portion of the solenoid 10. The iron core 15 has a conical surface 152 and a stepped center hole. A cylindrical protrusion 81 is disposed on an inside face of the upper cover 8. The cylindrical protrusion 81 forms an oblique hole 82 on an inside surface thereof for disposing a washer 84 and a seal 85. A bushing 83 is also disposed within a central hole of the upper cover 8 for the plunger 21 to slide thereon. The plunger 21 is provided with an externally threaded portion 211 at one end thereof for threadedly engaging with the iron core 15 and receiving a nut 70. At the other end of the plunger 21 is an internally threaded portion 210, wherein a first spring 212 and a buffer ring 213 are mounted. A positioning ring 214 is threadably fixed to an end of the internally threaded portion 210 to seal the buffer ring 213 and therefore the first spring 212. A T-shaped bolt 217 is further threaded into the buffer ring 213 and a rubber disk 218 is attached on top of the T-shaped bolt 217. Below a base ring 60 is the lower cover 9 within which is provided a plastic buffer washer 72. The lower cover 9 has a central opening which allows the nut 70 to pass through. It is noted that adjustment of the stroke of the plunger 21 can be achieved by moving the nut 70 along the externally threaded portion 211 thereof.

Figure 6:
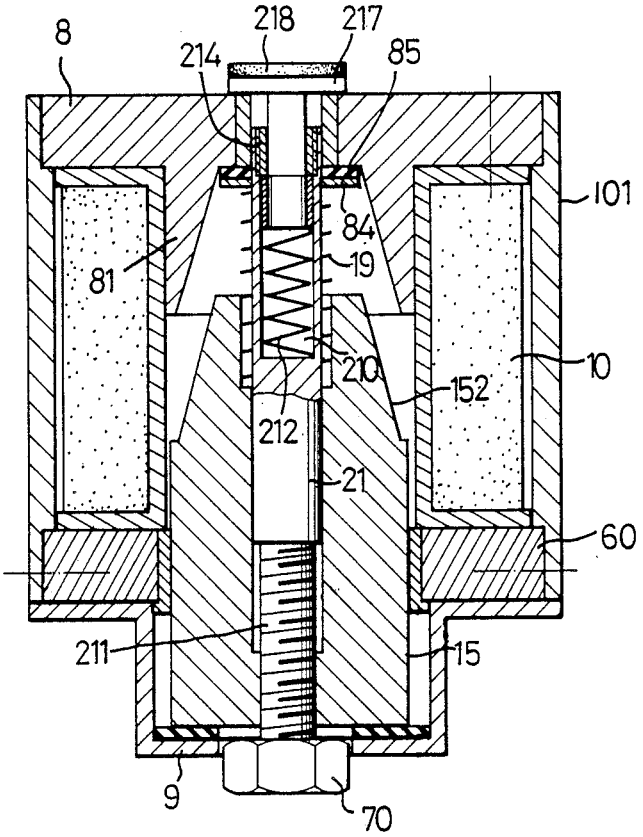
FIG. 6 is a sectional view of the transmission means of FIG. 4 when the solenoid therein is not energized.

FIG. 6 is a cross sectional view of the transmission means 2, illustrating the relative positions of each member with the solenoid 10 in the de-energized state. The solenoid 10 and the base ring 60 are disposed within the housing 101 and further encased by the upper cover 8 and lower cover 9, thus fixing the solenoid 10 within the housing 101. From FIG. 7 it can be seen that the iron core 15 is positioned in the center of the solenoid 10. The plunger 21, threaded through the center of the iron core 15, is fixed therein by the nut 70.

The base ring 60 is mounted at the bottom of the housing 101 for the iron core 15 to move freely on the central portion of the base ring 60. A second spring 19 is disposed within an upper portion of the stepped center hole of the iron core 15 with one end thereof urging the washer 84.

Figure 7:
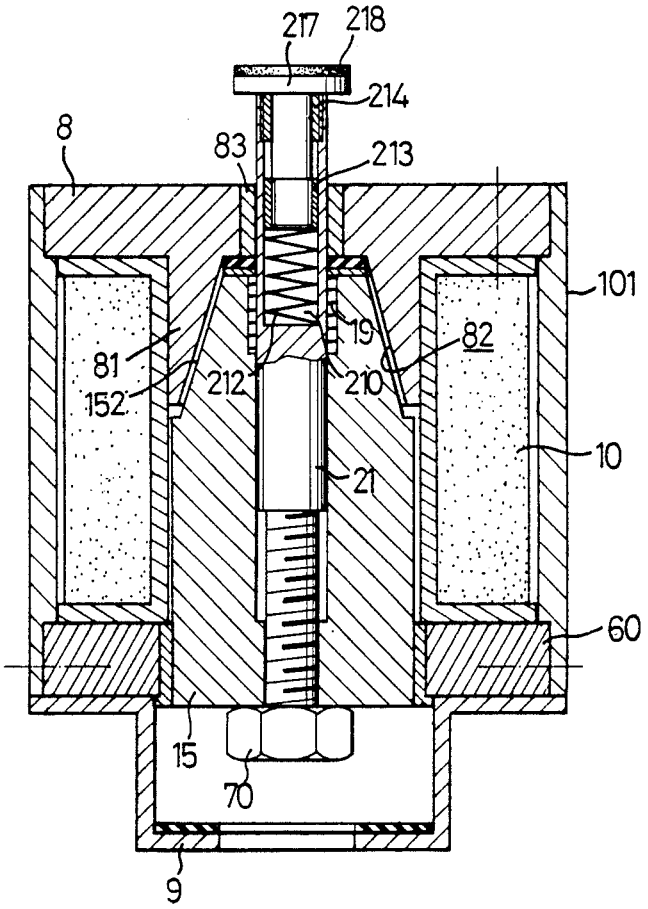
FIG. 7 is a view similar to FIG. 6 but with the solenoid therein energized.

When the solenoid 10 is energized, as shown in FIG. 7, the iron core 15 is urged forward, or upward in the figure, by induced magnetic force so that the plunger 21 is protruded over the upper cover 8. The iron core 15 is urged forward until the conical surface 152 thereof makes contact with the oblique hole 82 of the upper cover 8. The plunger 21 moves along with the iron core 15 because the threaded engagement therebetween. The first spring 212 prevents any damage to the transmission means 2 from sudden movement. The second spring 19 is compressed at this position. When the solenoid 10 is de-energized, the second spring 19 urges the iron core 15, and hence the plunger 21, to return to their original positions, as shown in FIG. 6.

The nut 70 is used to adjust the relative position between the iron core 15 and the plunger 21 to provide different strokes of protrusion of the plunger 21 relative to the upper cover 8, as required by different sewing machines.

Figure 8:
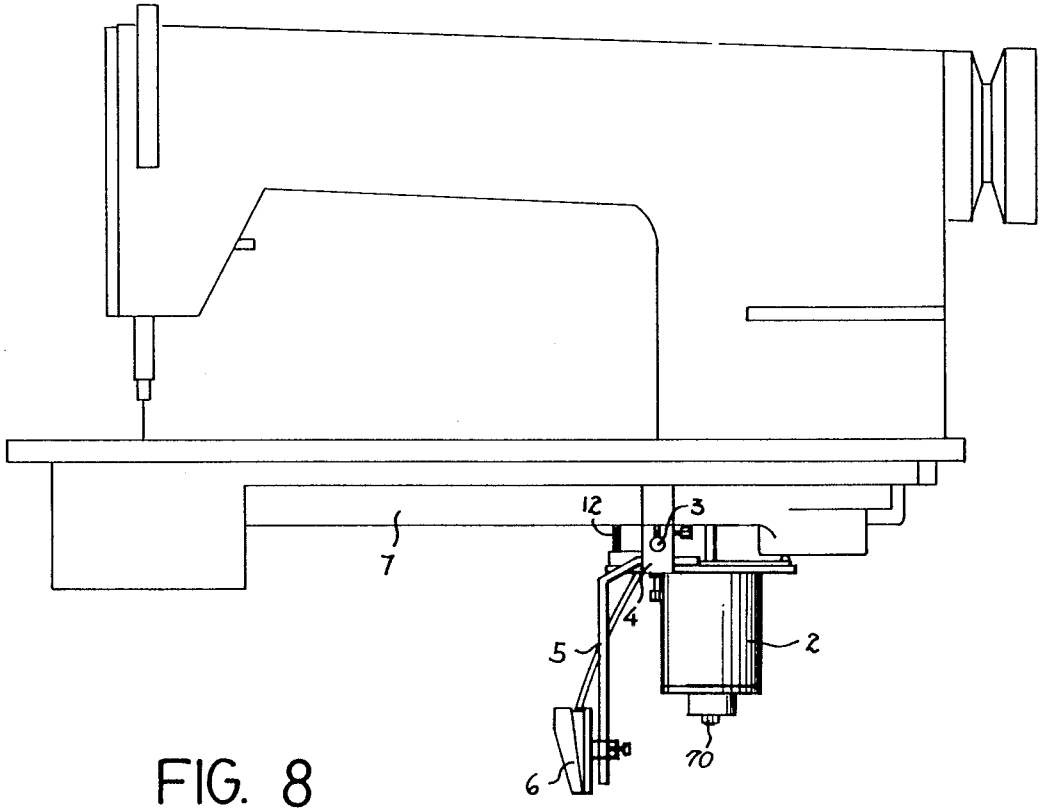
FIG. 8 shows the transmission mechanism of the present invention in vertically mounted position.
Figure 9:
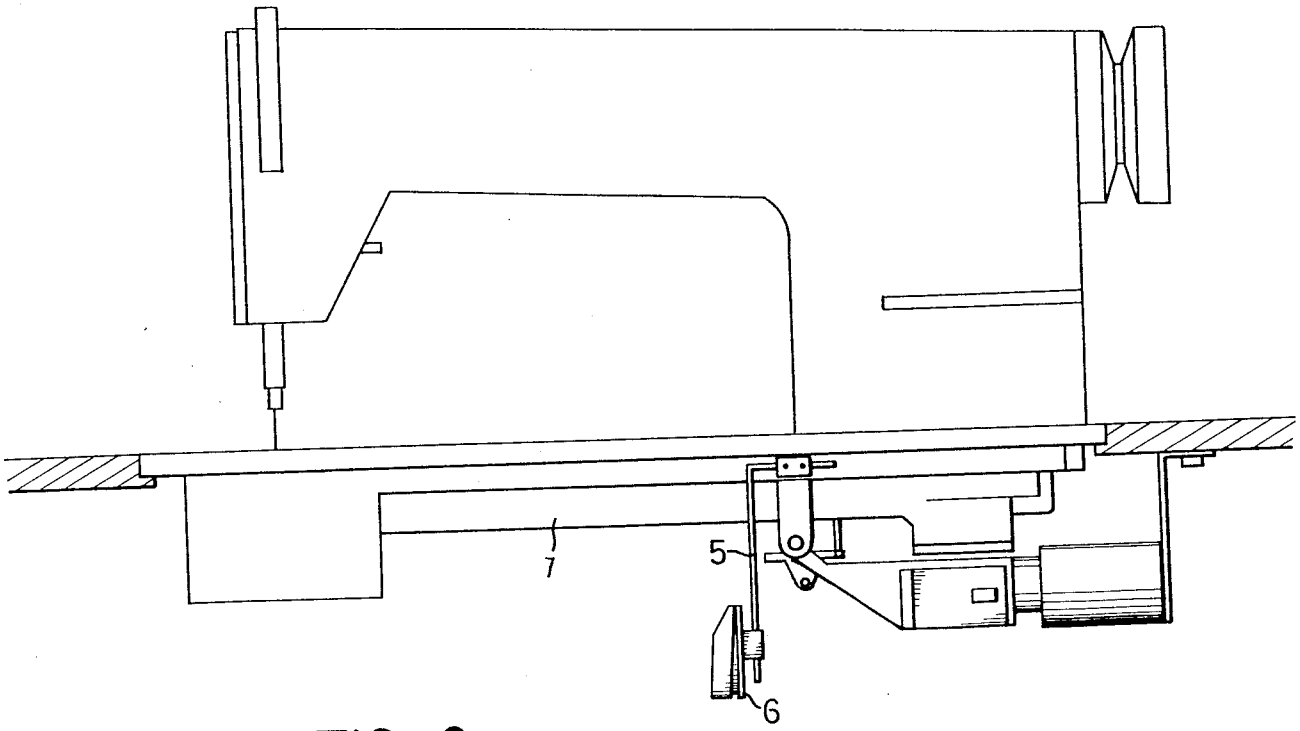
FIG. 9 PRIOR ART
FIG. 9 shows a prior art sewing machine wherein the transmission mechanism thereof is horizontally mounted.

FIGS. 8 and 9 respectively show the vertically mounted transmission means of the present invention and the horizontally mounted transmission means of the prior art. It is noted that, as the transmission mechanism of this invention incorporates, those parts that are externally exposed to the environment to form an integral part, the total length thereof is reduced. Therefore, it can be positioned vertically because it comprises fewer outward extending parts. Moreover, all parts are encased thus preventing the harmful effects of outside dust and other contaminants.

As various possible embodiments might be made of the above invention without departing from the scope of the invention, it is to be understood that all matter herein described is to be interpreted as illustrative. Thus, the scope of the invention is to be limited only by the scope of the appended claim.

I claim:

1. A transmission mechanism used for sewing machines having at least a carriage (7), said transmission mechanism comprising:

a base plate (1) having a plurality of mounts (11) formed thereon, four bolts (12) each having a plastic head and being threadably disposed at one of four respective corners of said base plate (1), said base plate (1) having an opening (13) being formed therethrough;

a switch box (6) supported by a first end of a connecting rod (5), said connecting rod (5) having a second end coupled to a fixing clamp (4);

a bar member (3) coupled to said fixing clamp (4) on one end thereof, said bar member (3) being additionally coupled to said plurality of mounts (11) of said base plate (1) and a carriage (7); and, transmission means (2) for controlling a sewing machine presser responsive to a control signal from said switch box (6), said transmission means (2) being vertically attached to said base plate (1) under said opening (13), said transmission means (2) having a plunger (21) passable through said opening (13), said plunger (21) being capable of performing a reciprocating vertical movement.

2. A transmission mechanism as claimed in claim 1, wherein said transmission means (2) further comprises:

a solenoid (10) being disposed within a housing (101), said solenoid (10) together with a base ring (60) being disposed within the housing (101) and further encased by an upper cover (8) and a lower cover (9), said upper cover (8) having a central hole for mounting a bushing (83) and a cylindrical protrusion (81) forming an oblique hole (82);

an iron core (15) being disposed within a center of said solenoid (10), said iron core (15) having a conical surface (152) and a stepped center hole, said stepped center hole having an upper portion and a lower threaded portion;

said plunger (21) being substantially disposed within said central hole of said iron core (15) and said upper cover (8), said plunger (21) having an externally threaded portion (211) and an internally threaded portion (210), said externally threaded portion (211) of said plunger (21) threadedly engaging with said iron core (15) and receiving a nut (70), said internally threaded portion (210) of said plunger (21) receiving a first spring (212) which is further sealed by a buffer ring (213), a positioning ring (214) and a T-shaped bolt (217), said positioning ring (214) being threaded to said internally threaded portion (210) of said plunger (21) and said T-shaped bolt (217) being further threaded to said buffer ring (213), a rubber disk (218) being attached on said T-shaped bolt (217);

a second spring (19) being disposed within said upper portion of said stepped center hole of said iron core (15) with one end thereof urging a washer (84); and, said plunger (21) together with said iron core (15) being slidable relative to said upper cover (8) and said base ring (60) to perform an upward movement when said solenoid (10) is energized and to perform a downward movement by said second spring (19) when said solenoid (10) is de-energized.

* * * * *